US005827093A

United States Patent [19]

Okabe

[11] Patent Number: 5,827,093

[45] Date of Patent: Oct. 27, 1998

[54] CONNECTOR COVER RETAINING STRUCTURE

[75] Inventor: Toshiaki Okabe, Shizuoka, Japan

[73] Assignee: Yazaki Corporation, Tokyo, Japan

[21] Appl. No.: 759,957

[22] Filed: Dec. 3, 1996

[30] Foreign Application Priority Data

Dec. 5, 1995 [JP] Japan ..... 7-316759

[51] Int. Cl.[6] ..... H01R 13/436

[52] U.S. Cl. ..... 439/752

[58] Field of Search ..... 439/752, 404, 439/689, 467

[56] References Cited

U.S. PATENT DOCUMENTS

| | | | |
|---|---|---|---|
| 5,120,269 | 6/1992 | Endo et al. | 439/752 |
| 5,147,222 | 9/1992 | Hotea et al. | 439/752 |
| 5,292,262 | 3/1994 | Endo et el. | 439/752 |
| 5,460,550 | 10/1995 | Okayasu et al. | 439/752 |
| 5,518,334 | 5/1996 | Yagi et al. | 439/752 |
| 5,567,184 | 10/1996 | Sasai et al. | 439/752 |

FOREIGN PATENT DOCUMENTS 4-15161 2/1992 Japan .

*Primary Examiner*—Gary F. Paumen
*Attorney, Agent, or Firm*—Sughrue, Mion, Zinn, Macpeak & Seas, PLLC

[57] ABSTRACT

A connector cover retaining structure in a connector in which a connector housing has an open portion through which terminals are exposed, and a cover is provided at the open portion for closing the open portion. The connector cover retaining structure includes a housing, terminal receiving chambers formed in the housing and separated from one another by side walls, an upper open portion formed in the housing to expose the terminal receiving chambers, a cover mounted on the housing through a hinge so as to close the upper open portion, projected portions formed respectively on the side walls, each of the projected portions having a retaining portion, and retaining pawls formed respectively on the cover and retainingly engaged respectively with the retaining portions of the projected portions when the cover is closed to close the upper open portion.

5 Claims, 4 Drawing Sheets

CONNECTOR COVER RETAINING STRUCTURE

BACKGROUND OF THE INVENTION

1. Field of the Invention

This invention relates generally to a connector in which a connector housing has an open portion through which terminals are exposed, and a cover is provided at the open portion for closing the open portion, and more particularly to a connector cover retaining structure for retaining the cover in its closed state relative to the open portion.

2. Description of the Related Art

There is known a so-called press-connecting connector in which a sheathed wire is press-fitted in a terminal received in a terminal receiving chamber, so that a sheath of the wire is cut by a press-connecting blade formed on the terminal, thereby electrically connecting the press-connecting blade to a conductor of the wire, thus connecting the wire to the terminal. Although such a press-connecting connector is excellent in mass productivity, it has a drawback that a wire holding force, withstanding a force acting in a direction to pull the wire, is small. Japanese Utility Model Unexamined Publication No. Hei. 4-15161 discloses one such connector having a cover for pressing wires, thereby achieving an increased wire holding force, and this connector will now be described with reference to FIGS. 5 and 6.

FIG. 5 is an exploded perspective view of a conventional connector with a cover, and FIG. 6 is a cross-sectional view of this connector in its assembled state. A plurality of juxtaposed terminal receiving chambers 3 are formed in a housing 1, and a rear end portion of the terminal receiving chamber 3, which is open to a rear end of the housing 1, serves as a mounting open port-ion 7 through which a terminal 5 is mounted in the terminal receiving chamber 3. The terminal 5 includes a press-connecting blade 9, and a pair of upstanding clamping piece portions 13 provided rearwardly of the press-connecting blade 9 for being clamped around a wire 11. The wire 11 is press-fitted in the press-connecting blade 9 of the terminal 5, and the pair of clamping piece portions 13 are clamped around the wire 11, and in this state the terminal 5 is mounted in the terminal receiving chamber 3. A retaining piece portion 14*a* of the terminal 5 is retainingly engaged with a retaining portion 14*b* formed within the terminal receiving chamber 3, thereby preventing the terminal 5 from disengaging from the terminal receiving chamber 3.

A wire holding cover 17 is provided at the mounting open portion 7 for closing this mounting open portion 7, and a wire holding projection 19 is formed on a lower surface of the cover 17. The cover 17 has a pair of retaining holes 21 provided respectively at opposite sides thereof, and the cover 17 is attached to the housing 1, with the retaining holes 21 retainingly fitted respectively on retaining pawls 23 formed respectively on opposite side walls of the housing 1.

In the conventional connector 25 of this structure with the cover, when the cover 17 is attached to the housing 1, the wires 11 are pressed by the wire holding projection 19, and therefore are bent to have bent portions 27, respectively, and because of the bent portions 27, each of the wires 11 withstands an external force acting in a direction to pull the wire. Also, by thus pressing the wires 11 by the wire holding projection 19, the rear end portions of the terminals 5 are prevented from being lifted.

In the above conventional connector 25 with the cover, however, the cover 17 is attached to the housing 1 merely by retainingly fitting the retaining holes 21, formed respectively at the opposite sides of the cover 17, on the retaining pawls 23 formed respectively on the opposite side walls of the housing 1, and therefore when a pulling force acts on the wire 11, the bent portion 27 is returned into a straight state, and particularly the central portion of the cover 17, having a reduced rigidity, is lifted, so that the function of holding the wire 11 is greatly lowered.

If the central portion of the cover 7 is lifted, the function of holding the wire 11 is lowered, and an external force can easily act directly on the terminal 5, and also the terminal 5 is liable to be lifted, and thus the terminal holding force is lowered, resulting in a problem that the terminal 5 is liable to be withdrawn.

Therefore, since the conventional cover retaining structure has the above problems, it has been difficult to produce a multi-pole connector having a large width in a direction in which the terminal receiving chambers 3 are juxtaposed.

SUMMARY OF THE INVENTION

With the above problems in view, it is an object of the present invention to provide a connector cover retaining structure which prevents a cover from being lifted, thereby enhancing a terminal holding force.

In order to accomplish the above object, the invention provides a connector cover retaining structure comprising: a housing; terminal receiving chambers formed in the housing and separated from one another by side walls; an upper open portion formed in the housing to expose the terminal receiving chambers; a cover mounted on the housing through a hinge so as to close the upper open portion; projected portions formed respectively on the side walls, each of the projected portions having a retaining portion; and retaining pawls formed respectively on the cover and retainingly engaged respectively with the retaining portions of the projected portions when the cover is closed to close the upper open portion.

DETAILED DESCRIPTION OF THE PREFERRED EMBODIMENT

A preferred embodiment of a connector cover retaining structure of the present invention will now be described in detail with reference to the drawings.

Figure 1:
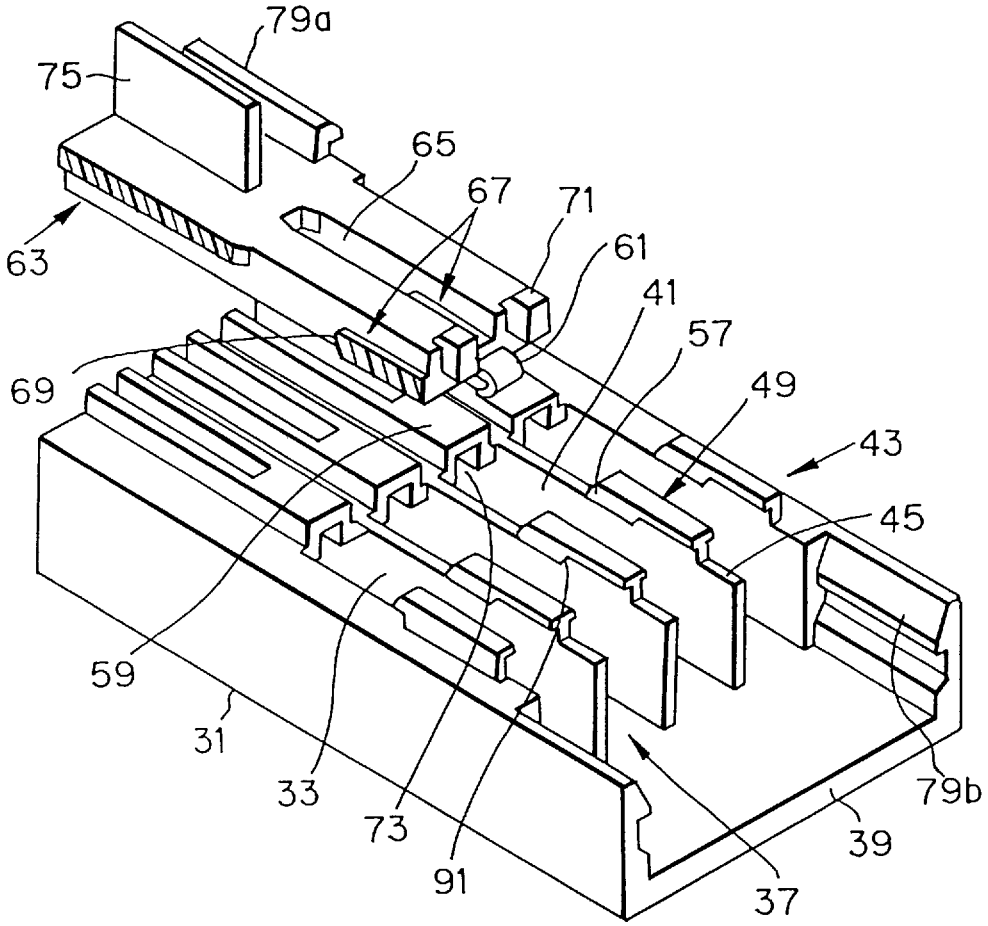
FIG. 1 is a perspective view of a connector cover retaining structure of the present invention, showing a cover in its open state.
Figure 2:
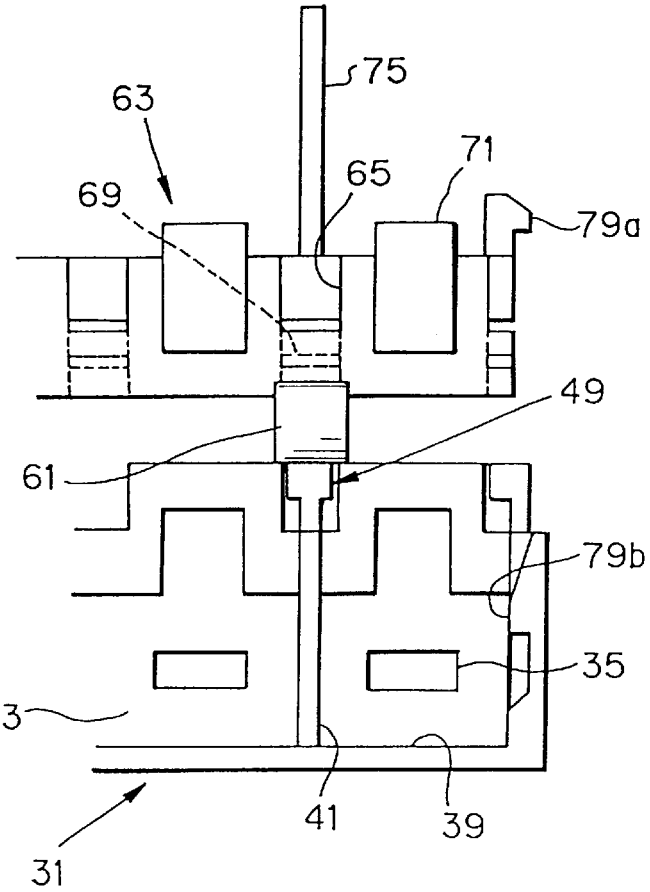
FIG. 2 is a rear view of a connector of FIG. 1.
Figure 3:
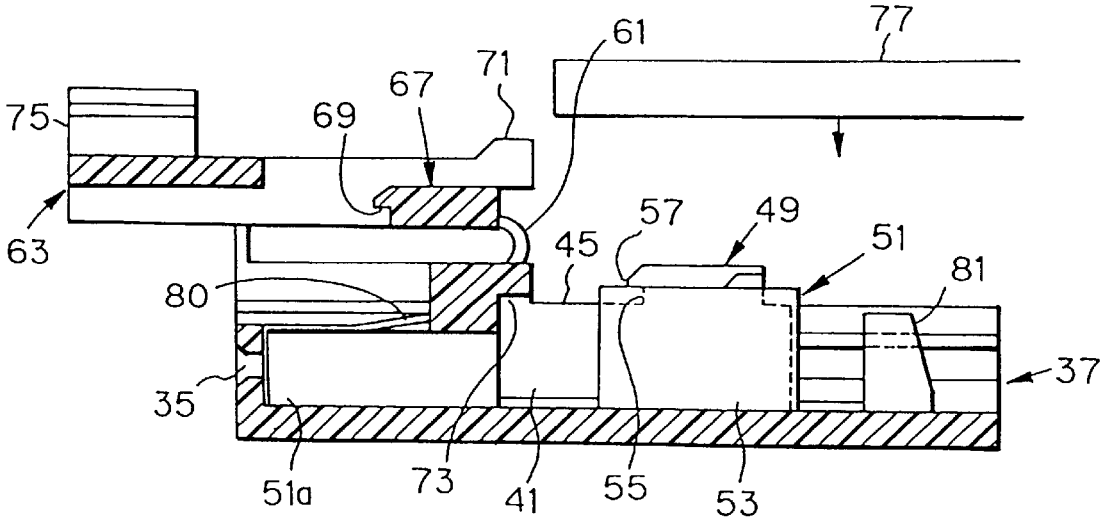
FIG. 3 is a vertical cross-sectional view of the connector of FIG. 1 having terminals mounted therein.
Figure 4:
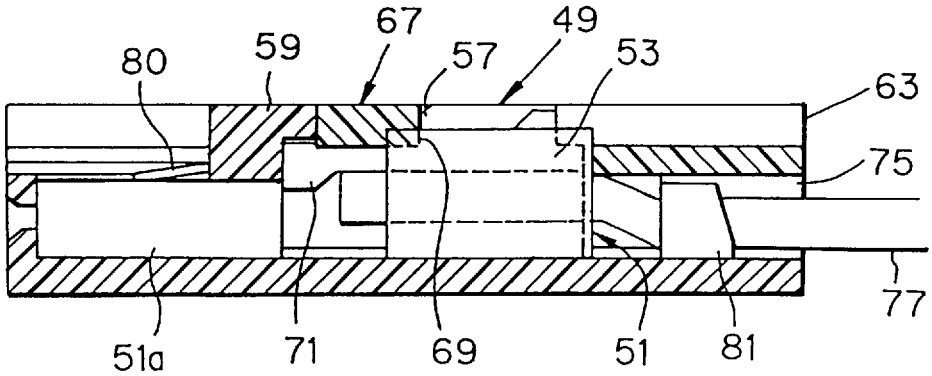
FIG. 4 is a vertical cross-sectional view of the connector of FIG. 1, showing the cover in its closed state.
Figure 5:
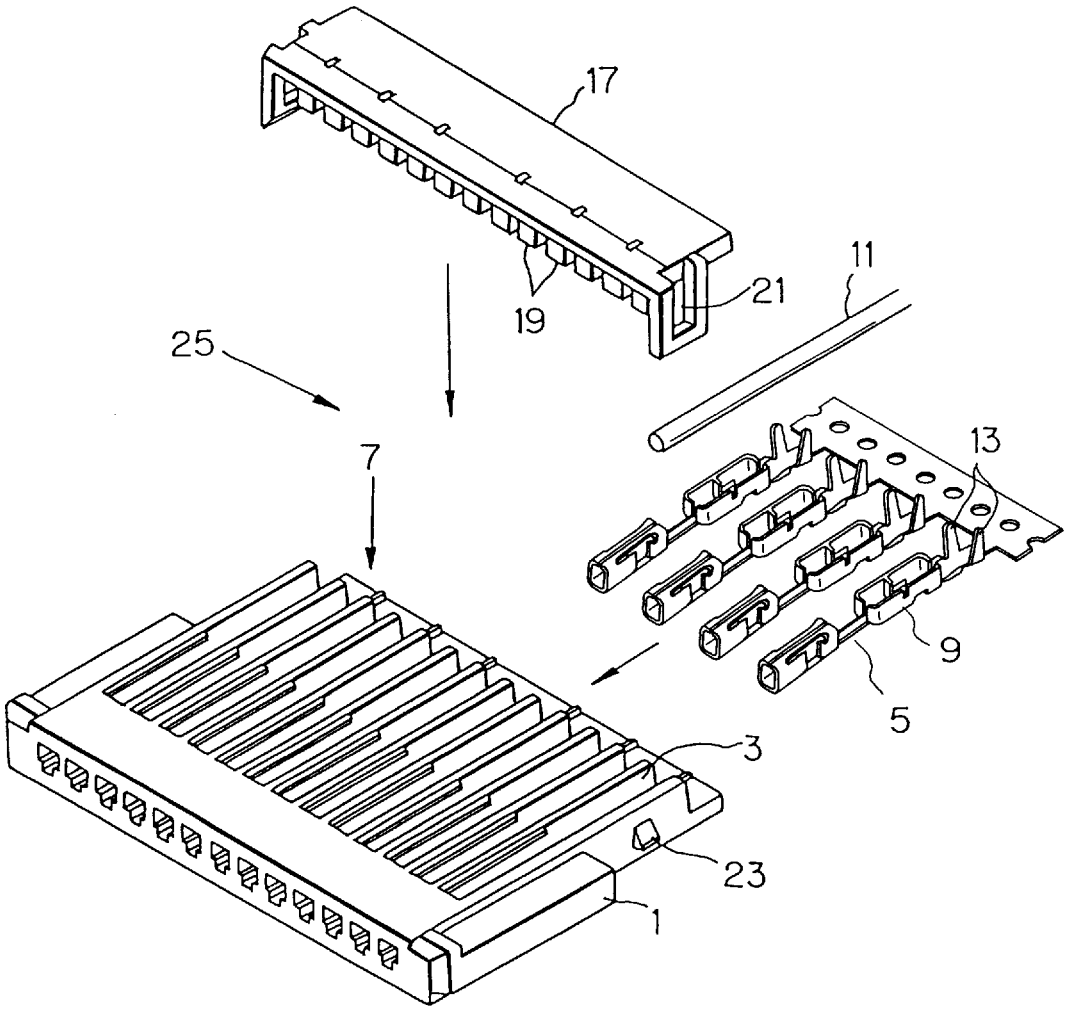
FIG. 5 PRIOR ART
FIG. 5 is an exploded perspective view of a conventional connector with a cover.
Figure 6:
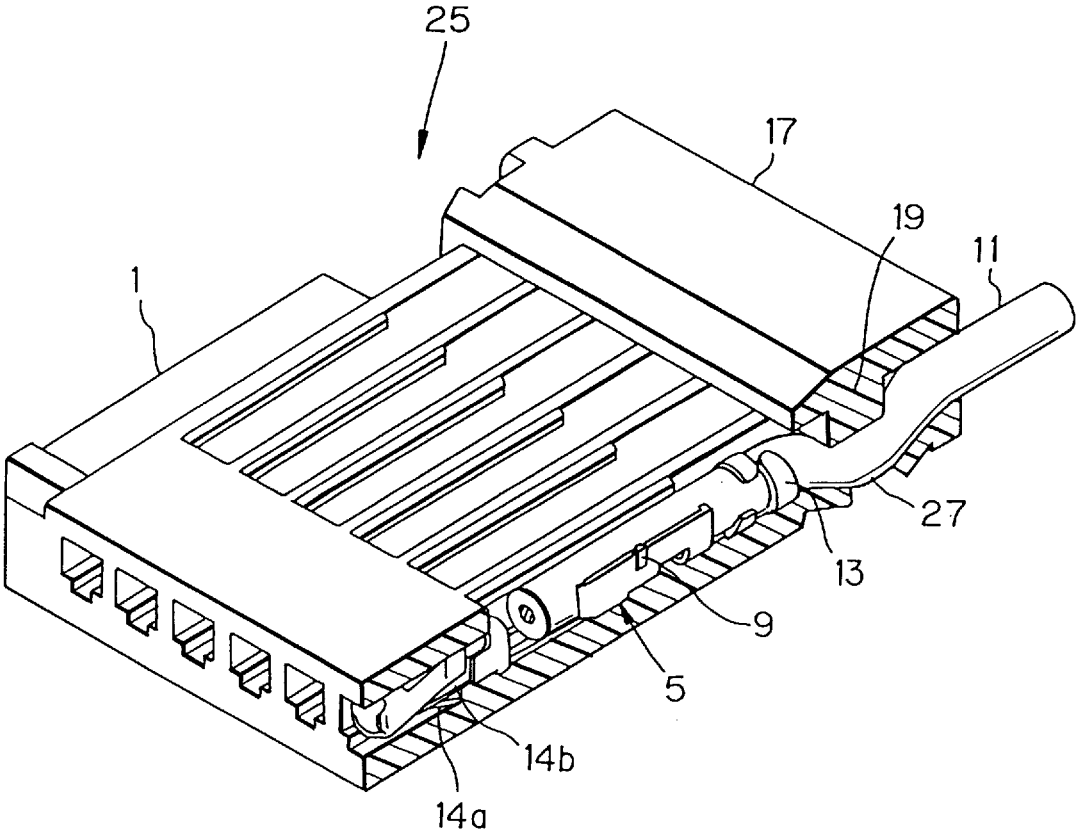
FIG. 6 PRIOR ART
FIG. 6 is a cross-sectional view of the conventional connector in its assembled state.

FIG. 1 is a perspective view of the connector cover retaining structure of the invention, showing a cover in its open state, FIG. 2 is a rear view of a connector of FIG. 1, FIG. 3 is a vertical cross-sectional view of the connector of FIG. 1 having terminals mounted therein, and FIG. 4 is a vertical cross-sectional view of the connector of FIG. 1, showing the cover in its closed state.

A housing 31 has a plurality of juxtaposed terminal receiving chambers 33, and each terminal receiving chamber 33 is open at its front end to a front surface of the housing 31 to provide an electric contact portion connection port 35 (see FIG. 3), and also is open at its rear end to provide a terminal insertion port 37 at a rear end portion of the housing 31. The terminal receiving chambers 33 are separated from one another by a plurality of parallel side walls 41 formed upright on a bottom wall 39 of the housing 31.

An upper open portion 43 is formed at that portion of the upper side of the housing 31 extending rearwardly from a substantially central portion thereof, and the terminal receiving chambers 33 are exposed through this upper open portion 43. A projected portion 49 is formed on an upper edge 45 of each side wall 41. The projected portion 49 overhangs the associated terminal receiving chamber 33, and projects to cover part of an upper opening of the terminal receiving chamber 33. Therefore, a press-connecting portion 53 of the terminal 51 (see FIG. 3), mounted in the terminal receiving chamber 33, abuts against a lower surface of the projected portion 49, thereby preventing the terminal 51 from being lifted.

A gap 55 is formed between the upper edge 45 of the side wall 41 and a front end portion of the projected portion 49 directed toward the front end of the housing. The front end of the projected portion 49 immediately above the gap 55 serves as a retaining portion 57. An upper plate 59 is formed on the upper side of the housing 31, and is disposed forwardly of the upper open portion 43. A cover 63 is pivotally mounted on the upper plate 59 through hinges 61. The cover 63 is pivotally moved through the hinges 61 to close the upper open portion 43.

Grooves 65 are formed in the cover 63 in correspondence with the side walls 41, respectively. When the cover 63 is closed, the projected portions 49 are fitted in the grooves 65, respectively. A retaining plate 67 is formed between opposed inner surfaces of each of the grooves 65 at one end portion of the groove 65 close to the hinge 61. A retaining pawl 69 is formed at one end of each retaining plate 67 remote from the hinge 61. When the cover 63 is closed, the retaining pawls 69 are retainingly engaged with the retaining portions 57 of the projected portions 49 respectively. Therefore, when the cover 63 is closed, the retaining plates 67, formed respectively at the grooves 65, are retainingly engaged with the projected portions 49, respectively.

Terminal retaining portions 71 are formed in a projected manner at the rear end surface of the cover 63 close to the hinges 61 in correspondence with the terminal receiving chambers 33, respectively. When the cover 63 is closed, the terminal retaining portions 71 are fitted respectively in recesses 73 formed in the lower surface of the upper plate 59, with their front (distal) ends retainingly engaged respectively with rear ends of electric connection portions 51*a* of the terminals 51 mounted respectively in the terminal receiving chambers 33. Partition walls 75 are formed on that side or surface of the cover 63 which can face the upper open portion 43, and can be disposed respectively on lines of extension of the side walls 41. When the cover 63 is closed, the partition walls 75 are disposed rearwardly of the side walls 41, respectively, to isolate wires 77, extending from the respective terminal receiving chambers 33, from one another.

A pair of lock pawls (lock means) 79*a* are formed respectively at the opposite sides of the cover 63, and can be retainingly engaged respectively with a pair of lock pawls (lock means) 79*b* formed respectively on the opposite inner side surfaces of the housing 31. The cover 63 is fixed to the housing 31 by engaging the lock pawls 79*a* respectively with the lock pawls 79*b*.

The operation of this connector cover retaining structure will now be described.

The wire 77 is press-fitted in the terminal 51 which is mounted in the terminal receiving chamber 33, and is retained there by a retaining piece portion 80. The wire 77 is thus press-fitted in the press-connecting portion 53 of the terminal 51, so that its insulating sheath is cut, thereby electrically connecting the press-connecting portion 53 to a conductor of the wire 77, thus connecting the wire 77 to the terminal 51. At this time, clamping piece portions 81, formed at a rear portion of the terminal 51, are clamped around the wire 77, and therefore the wire 77 is held by the terminal 51 through the clamping piece portions 81.

The cover 63 is pivotally moved through the hinges 61 to close the upper open portion 43, and the cover 63 is fixed at its rear portion to the housing 31 by engaging the lock pawls 79*a* respectively with the lock pawls 79*b*. At the same time, the projected portions 49, formed respectively on the side walls 41, are fitted respectively in the grooves 65 in the cover 63, and are retainingly engaged respectively with the retaining plates 67 formed respectively at the grooves 65.

Therefore, the cover 63 is not only retained relative to the housing 31 by the lock pawls 79*a* and 79*b*, but also retained relative to the side walls 41 of the housing 31, and therefore the cover 63 is increased in rigidity, and will not be flexed upon application of an external force through the wires 77 and the terminals 51.

When the cover 63 is closed, the terminal retaining portions 71 are received respectively in the terminal receiving chambers 33, and are retainingly engaged respectively with the rear ends of the electric connection portions 51*a* of the terminals 51, and therefore the terminal retaining portions 71 and the retaining piece portions 80 prevent the disengagement of the terminals 51 from the terminal receiving chambers 33 respectively in a double manner.

In the above connector cover retaining structure, the projected portions 49 are formed respectively on the side walls 41 of the housing 31, and the retaining plates 67 for retaining engagement respectively with the projected portions 49 are formed on the cover 63, and therefore when the cover 63 is closed, the cover 63 is retained relative to the side walls 41, and the lift of the cover 63 is positively prevented, to enhance the terminal holding force.

Also, if a wire holding projection (not shown) is formed on the cover 63, the cover 63 will be not lifted, and therefore bent portions can be positively formed on the respectively wires by the wire holding projection, and the wire holding force is not lowered, to positively retain the terminals 51.

The projected portions 49 are so formed as to abut against the press-connecting portions 53 of the terminals 51, respectively, and therefore each terminal 51 is positively prevented from being lifted in the terminal receiving chamber 33.

Further, the terminal retaining portions 71 for retaining engagement respectively with the rear ends of the electric connection portions 51*a* of the terminals 51 are formed on the cover 63, and therefore the terminal retaining portions 71 and the retaining piece portions 80 prevent the disengagement of the terminals 51 from the terminal receiving chambers 33 respectively in a double manner. In the structure of the invention, the cover 63 will not be lifted, and therefore the terminals 51 are retained with a uniform force.

In the above embodiment, although the retaining portions 57 for retaining engagement with the retaining plates 67 at the grooves 65 in the cover 63 are formed at the front portions of the projected portions 49 respectively, the structure for retaining the cover 63 relative to the projected portions 49 is not limited to this arrangement, and for example there may be used an arrangement in which step portions 91 (see FIG. 1) are formed on the opposite sides of each of the projected portions 49, and retaining pawls (not shown) for retaining engagement respectively with the step portions 91 are formed respectively on the opposed inner surfaces of each of the grooves 65. In such a structure, the opposite sides of each of the projected portions 49 are retainingly engaged with the opposed inner surfaces of each of the grooves 65, and therefore the number of the retaining portions is increased, so that the force of retaining the cover 63 relative to the housing 31 is further increased.

As described above, in the connector cover retaining structure of the invention, the projected portions are formed respectively on the side walls of the housing, and the retaining pawls for retaining engagement respectively with the projected portions are formed on the cover. Therefore, when the cover is closed, the cover is retained relative to the side walls, and therefore the cover is increased in rigidity, and will not be flexed. As a result, the cover is positively prevented from being lifted, and the terminal holding force is enhanced.

What is claimed is:

1. A connector cover retaining structure comprising:

a housing;

terminal receiving chambers formed in said housing and separated from one another by side walls;

an upper open portion formed in said housing to expose said terminal receiving chambers;

a cover mounted on said housing through a hinge so as to close said upper open portion;

projected portions formed respectively on said side walls, each of said projected portions having a retaining portion; and retaining pawls formed respectively on said cover and retainingly engaged respectively with the retaining portions of said projected portions when said cover is closed to close said upper open portion, wherein said retaining pawls are formed in retaining grooves on the underside of said cover and said retaining portions are formed on the lower portion of said projected portions.

2. The connector cover retaining structure according to claim 1, further comprising terminal retaining portions formed on said cover to respectively retain terminals mounted in said terminal receiving chambers when said cover is closed.

3. The connector cover retaining structure according to claim 1, wherein each of said projected portions projects into an associated terminal receiving chamber and abuts against a terminal mounted in said terminal receiving chamber, so as to prevent the terminal from being lifted in said terminal receiving chamber.

4. The connector cover retaining structure according to claim 1, further comprising a pair of lock pawls formed respectively at opposite sides of said cover, and another pair of lock pawls formed respectively on opposite inner side surfaces of said housing and retainingly engaged with the pair of lock pawls of said cover when said cover is closed.

5. The connector cover retaining structure according to claim 1, wherein said housing has an insertion port with an open area formed in front of said insertion port, so that a partition wall extending downward from said cover aligns longitudinally with said side walls in said open area to isolate terminals received in said housing.

* * * * *